US008151802B2

(12) United States Patent
Boldrini

(10) Patent No.: US 8,151,802 B2
(45) Date of Patent: Apr. 10, 2012

(54) METHOD FOR MANUFACTURING POUCHES OF COHESIONLESS MATERIAL

(75) Inventor: Fulvio Boldrini, Ferrara (IT)

(73) Assignee: Azionaria Costruzioni Macchine Automatiche A.C.M.A. S.p.A (IT)

( * ) Notice: Subject to any disclaimer, the term of this patent is extended or adjusted under 35 U.S.C. 154(b) by 151 days.

(21) Appl. No.: 12/312,652

(22) PCT Filed: Nov. 19, 2007

(86) PCT No.: PCT/IB2007/003606

§ 371 (c)(1),
(2), (4) Date: May 20, 2009

(87) PCT Pub. No.: WO2008/062301

PCT Pub. Date: May 29, 2008

(65) Prior Publication Data

US 2010/0071711 A1 Mar. 25, 2010

(30) Foreign Application Priority Data

Nov. 22, 2006 (IT) ..... BO2006A0792

(51) Int. Cl.
*A24B 1/08* (2006.01)

(52) U.S. Cl. ..... 131/112; 53/202; 131/283; 131/108

(58) Field of Classification Search ..... None
See application file for complete search history.

(56) References Cited

U.S. PATENT DOCUMENTS

| | | | | |
|---|---|---|---|---|
| 2,294,215 | A | 8/1942 | Sonneborn | |
| 3,026,660 | A | 3/1962 | Luthi | |
| 4,031,903 | A * | 6/1977 | Brackmann et al. | 131/109.2 |
| 4,067,173 | A | 1/1978 | Borrello | |
| 4,604,854 | A | 8/1986 | Andreas | |
| 4,703,765 | A | 11/1987 | Paules | |
| 5,694,741 | A | 12/1997 | Weder | |

FOREIGN PATENT DOCUMENTS

| | | |
|---|---|---|
| DE | 413602 C | 5/1925 |
| DE | 1045310 | 11/1958 |
| DE | 21 09 834 A1 | 9/1972 |
| DE | 2109834 | 9/1972 |
| DE | 25 20 659 A1 | 11/1976 |
| DE | 19535515 | 3/1997 |
| DE | 29620828 | 5/1997 |
| WO | 2005/113218 | 12/2005 |

OTHER PUBLICATIONS

Machined English Translation of DE2520659 1976.*
Machined English Translation of DE2109834 1972.*

* cited by examiner

*Primary Examiner* — Richard Crispino
*Assistant Examiner* — Phu Nguyen
(74) *Attorney, Agent, or Firm* — Timothy J. Klima; Shuttleworth & Ingersoll, PLC

(57) ABSTRACT

Pouches (2) of cohesionless material, typically a smokeless tobacco product, are manufactured by conveying portions of the tobacco initially on a dispensing disc (5*a*) with cavities (7) from a delivery station (8) to a transfer station (9), where each portion of tobacco is then removed forcibly from the relative cavity by an ejection system (14) and directed into a duct (12) connecting with a wrapping station (10) at which the pouches (2) are formed, filled and sealed; the removal and transfer of each portion from the cavity (7) of the disc (5*a*) into the duct (12) is controlled in such a way as to displace the material by degrees and ensure its smooth passage toward the wrapping station.

10 Claims, 4 Drawing Sheets

METHOD FOR MANUFACTURING POUCHES OF COHESIONLESS MATERIAL

This application is the National Phase of International Application PCT/IB2007/003606 filed Nov. 19, 2007 which designated the U.S. and that International Application was published under PCT Article 21(2) in English.

TECHNICAL FIELD

The present invention relates to a method of manufacturing individual bags or sachets of cohesionless material, and more precisely, pouches of nasal snuff, or of moist snuff (also known as snus) for oral use.

Reference is made explicitly to tobacco in the course of the following specification, albeit no limitation in scope is implied, as the cohesionless material might consist similarly, for example, in powdered pharmaceutical or confectionery products treated with moisturizing agents.

BACKGROUND ART

The prior art embraces machines of the type in question, which comprise a dispensing disc rotatable intermittently about a vertical axis and furnished with a ring of cavities, each containing a quantity or portion of tobacco that will correspond to the contents of a single pouch.

The portions are released into the single cavities at a filling station by a hopper containing a supply of powdered tobacco, en masse, treated with flavouring and moisturizing agents.

Downstream of the filling station, the machine comprises skimming means designed to remove any excess tobacco from each of the cavities.

With the disc in rotation, the cavities are carried beyond the skimming means and fed in succession to a station where the single portion of tobacco contained in each cavity is transferred to a further processing stage.

Installed at this same transfer station are pneumatic means comprising a nozzle positioned above the dispensing disc. At each pause in the movement of the disc, a portion of tobacco is ejected by the nozzle from the relative cavity and directed into a duct, of which the mouth lies beneath the disc and in alignment with the nozzle, thence toward a station where the single pouches are formed.

The forming station comprises a tubular element, placed at the outlet of the duct and functioning as a mandrel on which to fashion a tubular envelope of paper wrapping material.

The material in question consists in a continuous web of paper decoiled from a roll and fed in a direction parallel to the axis of the tubular element, which is wrapped progressively around the element and sealed longitudinally.

Beyond the tubular element, the machine is equipped with transverse sealing means of which the operation is synchronized with the transfer of the tobacco portions, in such a way that each successive portion will be sealed in a relative segment of the continuous tubular envelope of wrapping material delimited by two successive transverse seals.

The successive tubular segments of wrapping material, formed as pouches containing respective portions of tobacco, are separated into discrete units through the action of cutting means positioned downstream of the transverse sealing means.

It has been found impossible, utilizing machines of the type outlined above, to guarantee that the quantities of tobacco supplied to the form-fill-and-seal station will be portioned accurately and repeatedly over time.

This is due to the fact, especially when the size of the single portion increases beyond certain limits and the moisture content of the tobacco exceeds given values (typically 30%), that the aforementioned pneumatic ejection means cannot be guaranteed either to remove the contents of the single cavities completely, or to ensure that the portions of tobacco will pass correctly along the connecting duct; consequently, there is a risk that blockages may occur.

DISCLOSURE OF INVENTION

The object of the present invention, accordingly, is to provide a method and a relative machine for manufacturing single pouches of tobacco, such as will be unaffected by the drawbacks mentioned above in connection with machines of the prior art, and therefore able to combine a high production tempo with accurate and constantly repeatable dispensing of the tobacco portions contained in each of the single pouches, whatever the size of the selfsame portions. The stated object is realized, according to the present invention, in a method for manufacturing pouches of cohesionless material, as characterized in one or more of the claims appended.

SHORT DESCRIPTION OF THE DRAWINGS

The invention will now be described in detail, by way of example, with the aid of the accompanying drawings, in which:

FIG. 1 shows a machine in accordance with the present invention, viewed schematically in perspective and illustrated in a first embodiment;

FIG. 1*a* shows a detail of the machine in FIG. 1, viewed schematically and with certain parts cut away to reveal others;

FIG. 1*b* shows the detail of FIG. 1*a* in plan view from beneath;

FIG. 1*c* shows a detail of the machine in FIG. 1, viewed schematically and with certain parts seen in section, and illustrated in a second embodiment;

DETAILED DESCRIPTION OF THE PREFERRED EMBODIMENT OF THE INVENTION

Figure 1:
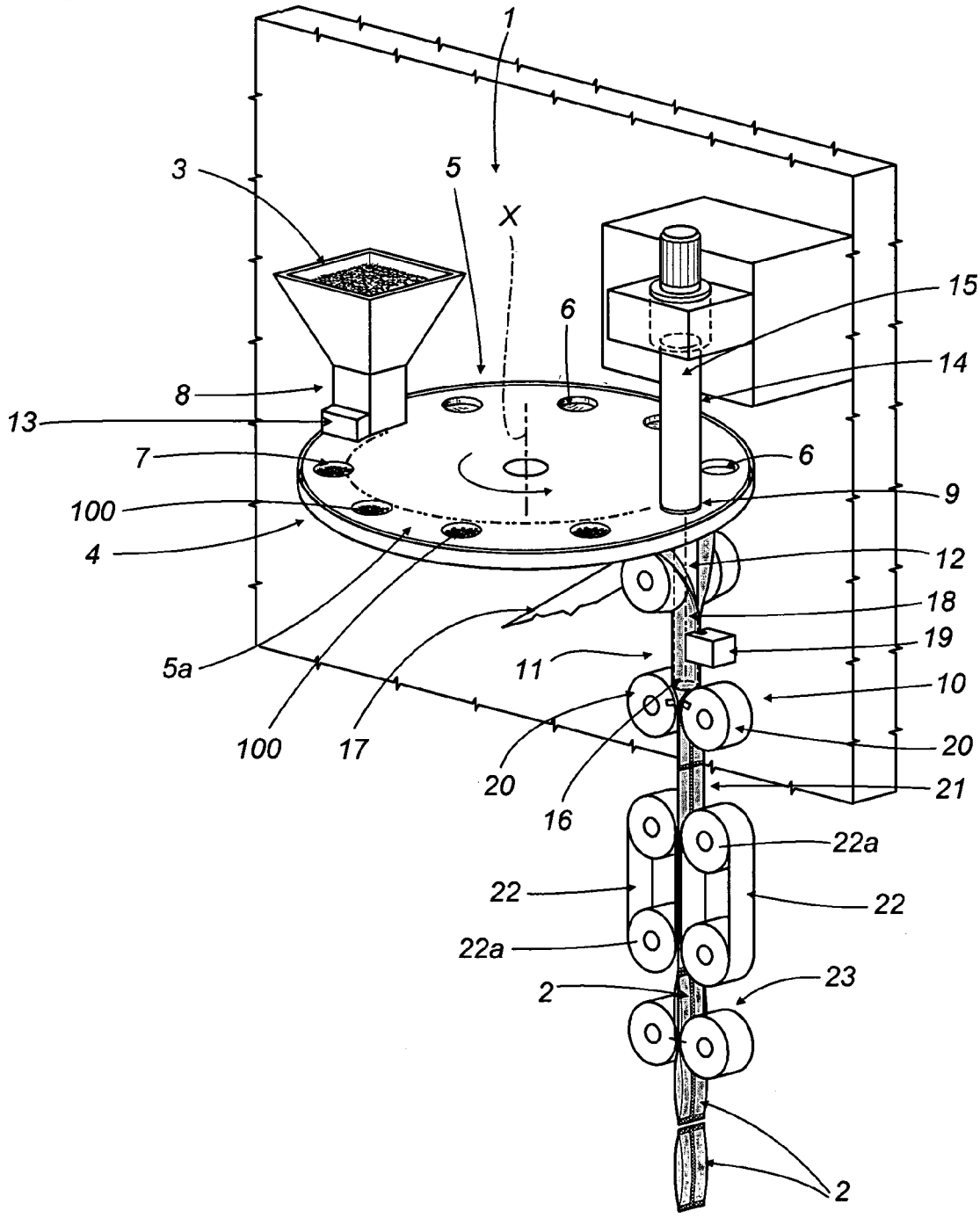

With reference to FIG. 1, numeral 1 denotes a machine for manufacturing pouches 2 containing a cohesionless material, in particular a smokeless tobacco product.

The machine 1 comprises a hopper 3 filled with the material in question, and conveying means 4 in the form of a conveyor 5 embodied as a dispensing disc, denoted 5*a*, furnished with a plurality of pockets 6 fashioned as bottomless cavities 7 of circular shape arranged around the periphery.

The dispensing disc 5*a* rotates intermittently and anticlockwise (as viewed in FIG. 1) about a relative axis X, between a delivery station 8 beneath the hopper 3, where each cavity 7 is filled with a predetermined portion 100 of tobacco, and a transfer station 9 at which the successive portions 100 of tobacco are ejected from the cavities 7.

The machine 1 further comprises a form-fill-and-seal wrapping station 10 where the portions 100 of tobacco removed from the transfer station 9 are taken up and enclosed in respective pouches 2.

Also indicated in FIG. 1 are interconnecting means 11, embodied as a rectilinear duct 12, interposed between the transfer station 9 and the wrapping station 10.

Numeral 13 denotes skimming means located downstream of the hopper 3, as referred to the direction of rotation of the disc, and serving to remove any excess quantity of tobacco from the cavity 7.

Figure 1A:
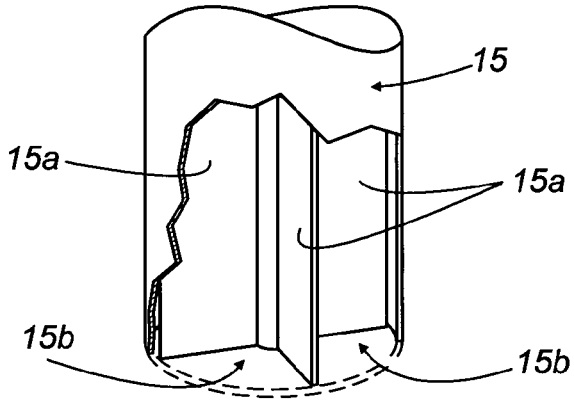
Figure 1B:
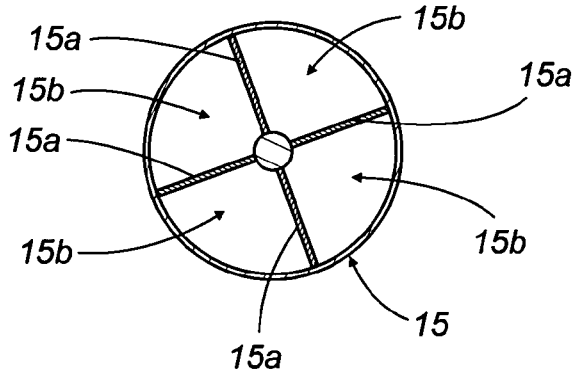

Referring to FIGS. 1 and 1*a*, the transfer station 9 is equipped with pneumatic forcing means 14, located above the disc 5*a*, comprising a tubular element 15 of diameter substantially equal to the diameter of the cavities 7, aligned on a vertical axis and divided internally by radial walls 15*a* into four sectors 15*b*, which is connected uppermost to a source of compressed air (not illustrated).

The wrapping station 10 comprises a tubular mandrel 16 positioned at the outlet end of the rectilinear duct 12, around which a continuous web 17 of wrapping material is formed into tubular envelope 18.

The web of material 17 is decoiled from a roll (not illustrated) and wrapped around the tubular mandrel 16, by degrees, through the agency of suitable folding means.

The edges of the web are joined and sealed longitudinally to form the tubular envelope 18 by ultrasonic welders 19 located in close proximity to the tubular mandrel 16.

Figure 2:
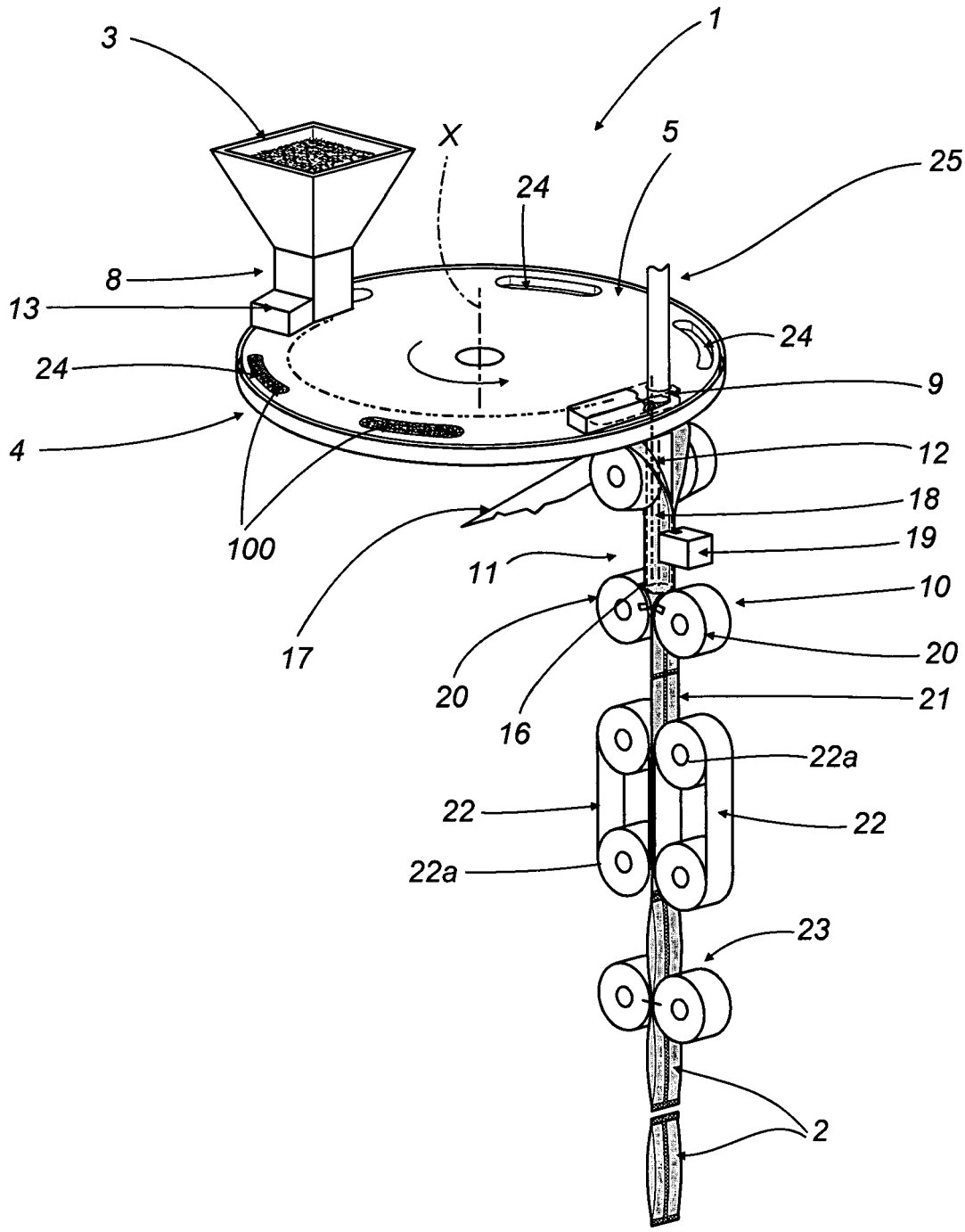
FIG. 2 shows a machine in accordance with the present invention, viewed schematically in perspective and illustrated in a second embodiment.

Referring to FIGS. 1 and 2, the machine 1 also comprises sealing means 20 located beneath the tubular mandrel 16, of which the function is to bond the tubular envelope 18 transversely and thus form a continuous succession 21 of pouches 2, each containing a single portion 100 of tobacco. The transverse sealing means 20 are followed downstream by a pair of transport belts 22 looped around respective pairs of pulleys 22*a*, serving to advance the continuous succession 21 of pouches 2 toward cutting means 23 by which the single pouches 2 of the selfsame succession 21 are divided one from the next.

In operation, with the disc 5*a* set in rotation, the cavities 7 are directed one by one under the hopper 3 and filled with respective portions 100 of tobacco, each destined to provide the contents of one pouch 2.

Each cavity 7 then passes under the skimming means 13, which will remove any excess tobacco released from the hopper.

Thereafter, the cavities 7 advance in succession toward the transfer station 9 and are positioned under the tubular element 15.

At this point, a pneumatic selector, schematized in FIG. 1 as a block 14*a*, connects the four sectors 15*b* of the tubular element 15 sequentially to the source of compressed air in such a way that corresponding jets are directed in succession onto different areas of the portion 100 of tobacco contained in the cavity 7.

As a result, the portion 100 of tobacco is removed by degrees from the respective cavity 7 and directed gradually into the duct 12 beneath.

Forced downward by the air jets, the portion 100 of tobacco passes along the rectilinear connecting duct 12 and into the tubular mandrel 16, which is ensheathed by the web 17 of wrapping material.

The envelope 18 of paper is sealed lengthwise by the ultrasonic welders 19, and crosswise, at the outlet end of the tubular mandrel 16, by the transverse sealing means 20.

The operation of the transverse sealing means 20 is intermittent, and timed to match the frequency at which successive portions 100 of tobacco are fed into the transfer station 9, in such a way that each portion 100 of tobacco will be enclosed between two successive transverse seals.

Thus, a continuous succession 21 of tobacco-filled pouches 2 will emerge, connected one to the next by way of the transverse seals.

At a given point downstream of the transverse sealing means 20, the single pouches 2 are separated one from the next by the cutting means 23.

In the embodiment of FIG. 2, the pockets of the dispensing disc 5*a* are fashioned as elongated slots 24 and the forcing means 14 consist in a single pneumatic nozzle 25 positioned at the transfer station 9.

In this instance, the portions 100 of tobacco are transferred from the slots 24 to the duct 12 with the disc 5*a* in rotation, as each single slot 24 passes beneath the nozzle 25.

Likewise in this solution, the transfer of the portions 100 of tobacco into the rectilinear duct 12 occurs gradually.

Figure 3:
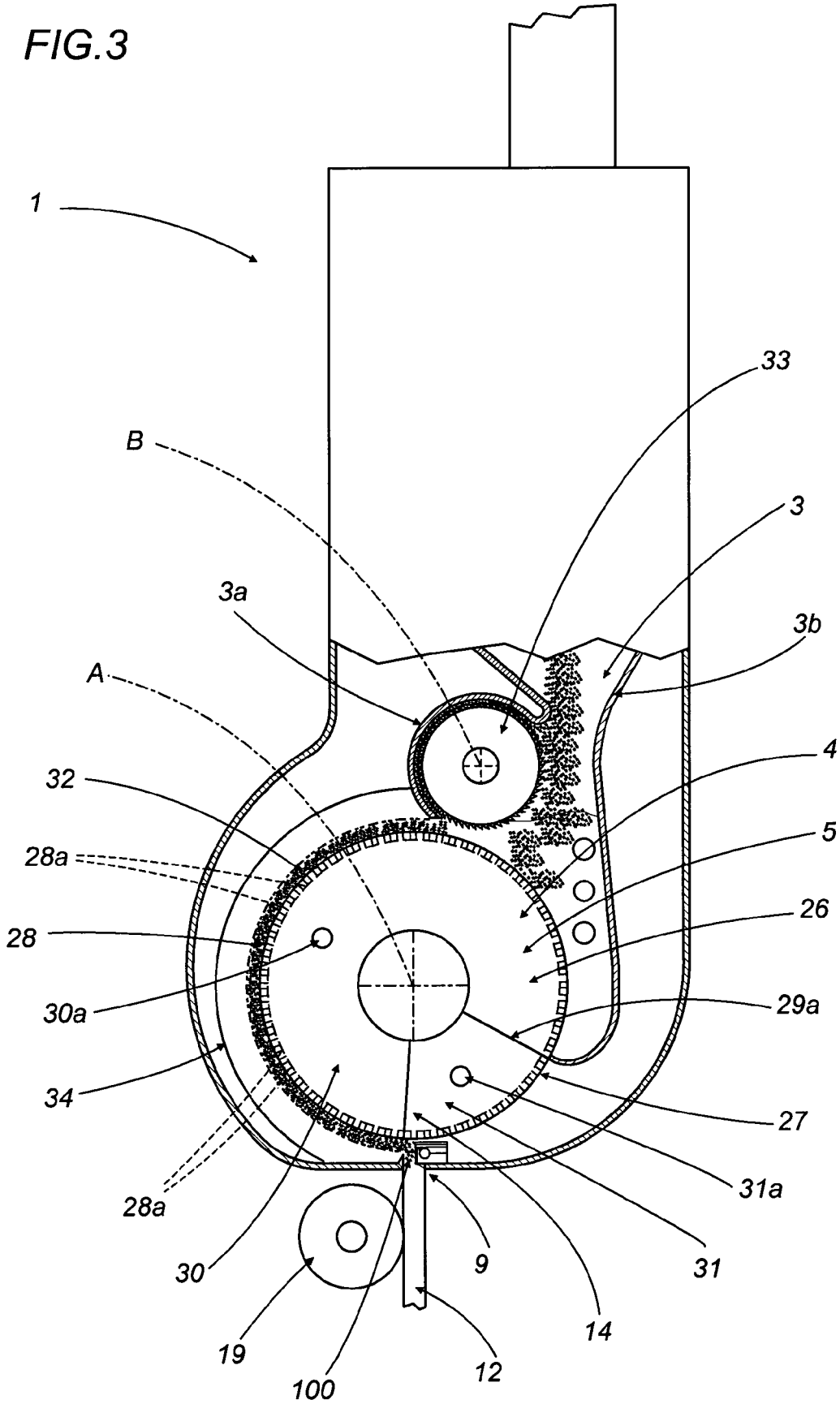
FIG. 3 shows a third embodiment of a machine according to the present invention, viewed schematically in elevation.

In a further embodiment (see FIG. 3), the conveying means 4 appear as a drum 26 rotatable intermittently and anticlockwise, as viewed in FIG. 3, about a horizontal axis A. The drum 26 is interposed between a bottom end of the hopper 3, delimited by two side walls 3*a* and 3*b*, and the transfer station 9.

The drum 26 presents a cylindrical wall 27 with a band 28 of predetermined width rendered permeable to air by a plurality of through holes 28*a*.

The enclosure 29 delimited by the cylindrical wall 27 is divided by two radial walls 29*a* and 29*b* into two sectors, denoted 30 and 31.

A first sector 30, located adjacent to the outlet of the hopper 3 and extending around to the transfer station 9, is connected by way of a duct 30*a* to a source of negative pressure (not illustrated).

The remaining sector 31, positioned adjacent to and above the transfer station 9, is angularly complementary to the first sector 30 and connected by way of a further duct 31 a to a source of compressed air (not illustrated).

In operation, with the drum 26 set in rotation and exposed to the aspirating action of the negative pressure source, the air-permeable band 28 will gradually collect a continuous stream 32 of tobacco, which is kept at a prescribed and constant thickness through the action of a levelling roller 33 rotating similarly anticlockwise about an axis B parallel to the axis A aforementioned, internally of the hopper 3 and adjacent to one side wall 3*a*.

The continuous stream 32 advances between two side panels 34 extending concentrically with the drum 26 as far as the transfer station 9, where a given length of the stream 32, corresponding in quantity to one portion 100, will be detached gradually from the drum by a jet of compressed air forced through the holes 28*a* of the air-permeable band 28, and directed into the duct 12 in the manner described previously with reference to other embodiments.

It will be seen that the forcing means 14, which are pneumatic in the various embodiments described thus far, might also be of mechanical design.

Figure 1C:
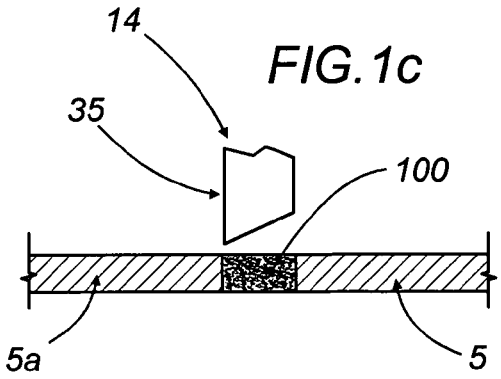

In effect, FIG. 1*c* illustrates an alternative solution to that of FIG. 1, in which the forcing means 14 are embodied as a plunger 35 invested with reciprocating motion and insertable through the cavities 7 of the dispensing disc 5*a* when positioned at the transfer station 9.

In this embodiment, the penetrating end of the plunger 35 presents a shape, for example skew, such as will allow the portion 100 of tobacco to be engaged and displaced from the cavity by degrees, as described previously with reference to other embodiments.

Finally, the forcing means 14 might consist in a combination of mechanical and pneumatic means operating on different parts of the single portion 100, at the transfer station.

The elements of the design as described above are readily applicable to a twin track type of machine.

In this instance, the conveying means will consist either in a disc with two rings of cavities, or a drum with two air-permeable bands, in such a way that two portions of tobacco can be supplied simultaneously to the transfer station, and each then directed into a respective duct.

Self-evidently, adopting the method and the machine according to the present invention, the aforementioned drawbacks connected with the prior art can be overcome, inasmuch as the portions of tobacco can be transferred correctly, even when relatively large, with no risk of blockages occurring along the connecting duct that would dictate a stoppage of the machine.

The invention claimed is:

1. A method for manufacturing pouches of at least one of a nasal snuff and a moist snuff for oral use, including the steps of:

feeding the snuff with a conveying mechanism from a delivery station to a transfer station, the conveying mechanism having a dispensing disc with cavities, rotatable about an axis;

filling each cavity with a predetermined portion of snuff from a hopper;

skimming excess snuff from the cavity downstream of the hopper, relative to a direction of rotation of the dispensing disc;

transferring predetermined portions of the snuff, by use of a forcing mechanism operating at the transfer station, from the conveying mechanism to at least one duct connecting with a wrapping station where the pouches are formed, filled and sealed, the transferring step comprising removing each portion by degrees from the conveying mechanism such that the portion is directed gradually into the duct.

2. A method as in claim 1, wherein the forcing mechanism is a pneumatic mechanism.

3. A method as in claim 1, wherein the step of transferring each portion effected by the pneumatic mechanism includes causing the snuff making up the predetermined portion to be ejected gradually from each cavity.

4. A method as in claim 1, wherein the step of transferring each portion is effected with the dispensing disc stationary.

5. A method as in claim 1, wherein the step of transferring each portion is effected with the dispensing disc in rotation.

6. A method as in claim 1, wherein the feeding step includes a step of forming a continuous stream of the snuff on an aspirating conveyor mechanism.

7. A method as in claim 6, wherein the transfer step includes causing a given fraction of the continuous stream, corresponding in quantity to the predetermined portion, to be removed from the aspirating conveyor mechanism by the pneumatic mechanism at the transfer station.

8. A method as in claim 1, wherein the snuff is tobacco.

9. A method as in claim 2, wherein the feeding step includes a step of forming a continuous stream of the snuff on an aspirating conveyor mechanism.

10. A method as in claim 9, wherein the transfer step includes causing a given fraction of the continuous stream, corresponding in quantity to the predetermined portion, to be removed from the aspirating conveyor mechanism by the pneumatic mechanism at the transfer station.

* * * * *